United States Patent [19]

Ganz

[11] 4,221,491

[45] Sep. 9, 1980

[54] PEN CONSTRUCTION

[75] Inventor: Walter C. Ganz, New York, N.Y.

[73] Assignee: Walgan Corp., New York, N.Y.

[21] Appl. No.: 23,885

[22] Filed: Mar. 26, 1979

[51] Int. Cl.[2] ..... B43K 27/12

[52] U.S. Cl. ..... 401/33

[58] Field of Search ..... 401/32, 33, 30, 29, 401/21, 19, 110

[56] References Cited

U.S. PATENT DOCUMENTS

| | | | |
|---|---|---|---|
| 2,826,173 | 3/1958 | Gossweiler et al. | 401/33 |
| 3,164,132 | 1/1965 | Ganz | 401/33 |
| 3,797,945 | 3/1974 | Zepell | 401/33 |
| 3,837,748 | 9/1974 | Wada | 401/33 |

*Primary Examiner*—J. Yasko

*Attorney, Agent, or Firm*—Howard C. Miskin

[57] ABSTRACT

A multiple unit writing instrument includes end to end relatively rotatable barrel section housing a body member rotatable with the front barrel section and a cylindrical cam rotatable with the rear barrel section and having in its outer face a longitudinal guide groove extending to the raised portion of the end cam face and slidably engaged by an actuating member. A pair of writing elements are slidable in guideways in the body member between advanced and retracted positions and carry followers engaging guide slots and the cam face. One of the writing elements is a mechanical pencil including a pencil lead engaging clutch controlled by a rearwardly projecting spring biased plunger which is engaged by a corresponding follower so that when the cam is turned to advance this element to its operative position and the actuating member then longitudinally advanced to depress the plunger the pencil lead is propelled, the further forward movement of the pencil element being restricted by the barrel front opening border. A spring retracted rear push button is coupled to the actuating member and the followers are spring retracted to engage the cam face.

10 Claims, 10 Drawing Figures

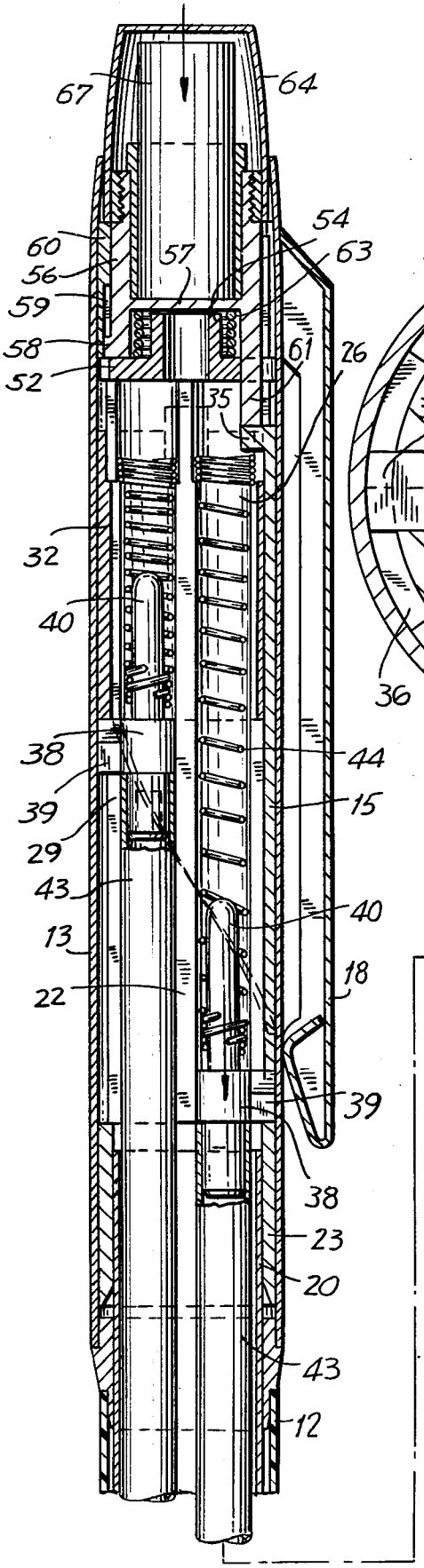
FIG. 7
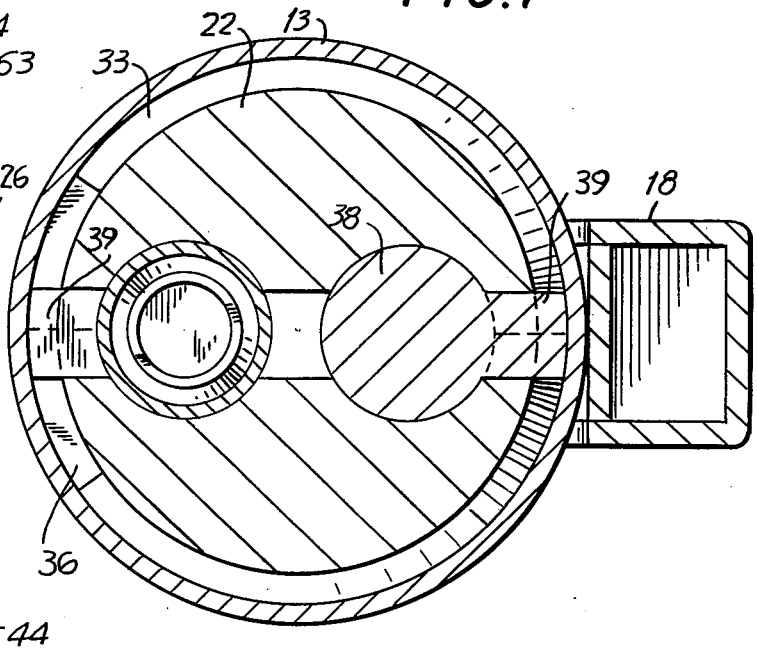
FIG. 9
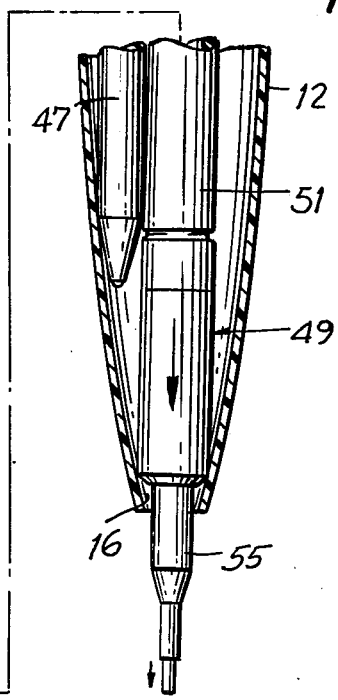

PEN CONSTRUCTION

BACKGROUND OF THE INVENTION

The present invention relates generally to improvements in writing instruments and it relates more particularly to an improved writing instrument having multiple writing units, at least one of which is a mechanical pencil having a propel-repel mechanism.

There are many types of multiple unit writing instruments which have been heretofore available and proposed in which a selected writing element may be protracted with the retraction of the other writing elements. Such writing instrument which is highly satisfactory is disclosed in U.S. Pat. No. 3,266,465 granted Aug. 16, 1966 to W. C. Ganz. However, the aforesaid writing instrument employs writing elements such as of the ball point type which require no individual adjustment. A well known type of adjustable writing element employs a pencil lead and includes a spring retracted axial plunger the depression of which releases and advances the lead and the retraction of which locks the lead in its advance position. This mechanical pencil writing element of its propel-repel type cannot be conveniently employed with the aforesaid multiple unit writing instrument and although multiple unit writing instruments have been available in which one of the writing elements is a propel-repel pencil element, these instruments are generally complex and unreliable, of little versitility and adaptability and otherwise leave much to be desired.

SUMMARY OF THE INVENTION

It is a principal object of the present invention to provide an improved writing instrument.

Another object of the present invention is to provide an improved multiple unit writing instrument.

Still another object of the present invention is to provide an improved multiple unit writing instrument in which individual writing elements are selectively advanced to operative position while the other writing elements are retracted and at least one of the writing elements is individually adjustable by manipulation of the instrument without direct manual access to the adjustable writing element.

A further object of the present invention is to provide an improved multiple unit writing instument of the above nature characterized by its high reliability, ruggedness, convenience and ease of use and adjustment and great versitility and adjustability.

The above and other objects of the present invention will become apparent from a reading of the following description taken in conjunction with the accompanying drawings which illustrate a preferred embodiment thereof.

In a sense the present invention contemplates the provision of an improved multiple unit writing instrument comprising a barrel having a front end opening, a plurality of writing units located in said barrel and individually longitudinally movable therein between an advanced position projecting through the front opening and a retracted position, at least a first of the writing units being individually adjustable in response to a compressive force applied thereto, means for limiting the advance movement of the first writing unit, a follower member coupled to each of the writing units, a cam member located in the barrel and engaging and rotatable relative to the follower members whereby rotation of the cam member individually advances the follower members and respective writing units and retracts the remaining follower member and writing units, and an actuating member carried by the cam member and being longitudinally movable along a path intercepting the follower member coupled to the first writing unit when the latter is in its advanced position whereby to apply a compressive force to the first writing unit when in its advanced position to effect the adjustment thereof.

In the preferred form of the improved writing instrument the barrel includes relatively rotatable coaxial upper rear and lower front coaxial barrel sections and a cylindrical body member located in the top barrel section and rotatable therein by and connected to the bottom barrel section, the body member having longitudinal peripherally spaced guide bores provided with longitudinal outer slots. The cam is cylindrical and includes a forward cam face with a single raised portion and rotatably engages the body member and is coupled to the upper barrel section so as to be rotatable with the upper barrel section. A longitudinal guide groove is formed in the cam outside face and interacts the cam raised portion apex and the actuating member is an elongated bar slidably engaging the groove. Each of the longitudinal guide bores is slidably engaged by a writing unit gripping clutch which carries a follower member projecting through a corresponding slot into engagement with the cam face. The clutches are spring are spring retracted to retract the writing units and urge the follower members into cam engagement. The first writing unit, is a mechanical pencil device which includes a lead clutch which is actuated by a rearwardly projecting spring biased plunger, the advance of which releases the lead clutch and advances the lead and is of well known construction. Thus when the first writing unit is advanced by the rotation of the cam to its operative position where it is prevented from further advance, longitudinal advance of the actuating member depresses the pencil plunger to advance the pencil lead. A spring retracted plunger button projects from the rear of the barrel and engages the actuating member so that depression of the button longitudinally advances the actuating member.

The improved multiple unit writing instrument is highly reliable, rugged, of easy and convenient operation and of great versitility and adaptability.

BRIEF DESCRIPTION OF THE DRAWINGS

FIG. 7 is a sectional view taken along line 7—7 in FIG. 2;

FIG. 9 is a longitudinal sectional view similar to FIGS. 2 and 3 showing the adjustable writing unit in advanced operative position and in a lead release condition.

DESCRIPTION OF THE PREFERRED EMBODIMENT

Figure 1:
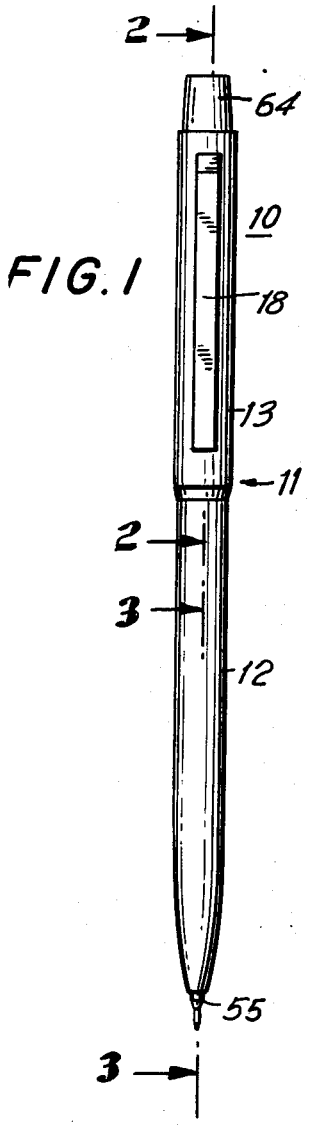
FIG. 1 is a front elevational view of a writing instrument embodying the present invention.

Referring now to the drawings which illustrate a preferred embodiment of the present invention as applied to a dual writing unit writing instrument in which one of the units is adjustable, specifically a mechanical pencil, and the other unit non-adjustable, specifically a ball point pen or the like it being understood that the writing instrument may include more than two writing units more than one of which may be adjustable, the reference numeral 10 generally designates the improved writing instrument which comprises a hollow barrel 11 including relatively rotatable end-to-end coaxial front lower tubular barrel section 12 and a rear upper tubular barrel section 13. The front barrel section 12 inwardly forwardly tapers at its front end to a front end opening 14 bordered by an inclined inside shoulder 16 and the rear barrel section terminates at its top in a rear opening 17. A clip member 18 of conventional construction has its upper end affixed to the upper border of rear barrel section 13.

Barrel section 12 and 13 engage the opposite ends of an intermediate coupling collar 19 and abut outside peripheral shoulders thereon to permit relative rotation of the barrel sections, the lower sections 12 being separable from collar 19. A coupling sleeve 20 slidably telescopes the upper end of lower barrel section 12 and is releasably frictionally retained therein and is provided with a longitudinal rib 21 engaging the inside face of lower section 12 so that sleeve 20 is rotatable with barrel lower section 12.

A unitary body member 22 extends coaxially longitudinally in upper barrel member 13 and is rotatable therein and terminates at its bottom in a tubular coupling section 23 whose inside face tightly embraces the upper outside face of sleeve 20 so as to be rotatable therewith. Body member 12 is of outside cylindrical configuration and is spaced from the inside face of upper barrel section 13 and has formed therein a pair of diametrically opposite longitudinally extending guide bores 26 extending from the coupling section 23 to the top of body member 22 and terminating at their upper parts in enlarged bores delineated from guide bores 23 by shoulders 28. A longitudinal guide slot 29 is formed in the outer wall of each guide bore 26 and extends for the full length thereof to the top of coupling section 23.

A tubular cylindrical cam 32 telescopes upper barrel section 13 and in turn is telescoped by the body member 22 above coupling section 23, the cam 32 being rotatable relative to body member 22 and being connected to upper barrel section 13 so as to be rotatable therewith. Cams 32 has a downwardly directed 360° cam face 33 including a lowermost raised portion 34 having a recess or notch in its apex and an uppermost depressed horizontal dwell portion 36 diametrically opposed to raised portion 34 and joined thereto by opposite inclined runs.

Formed in the outer peripheral face of cam member 32 in longitudinal alignment with the apex of the cam raised portion 33 is a longitudinal rectangular guide groove or channel which is longitudinally slidably engaged by an actuating member defining rectangular elongated bar 15. The bar 15 is movable along its length between a retracted position with its bottom or leading end disposed shortly above the apex of cam raised portion 33 and an advanced position with the bar leading end being below the cam raised portion apex at least a predetermined distance. Projecting radially inwardly from the top of actuating bar 15 and integrally formed therewith is an arm or leg 35.

A follower member 37 is longitudinally slidably disposed in each guide bore 26 and includes a cylindrical body 38 coaxial with and slidably engaging the face of respective bore 26, a prison shaped follower element 39 radially projective through a respective guide slot 29 and having a top apex, an upwardly directed shank 40 embraced by a helical coupling spring 41 and a depending stub 42 tightly telescoping a depending clutch tube 43. A helical tension spring 44 is located in each guide bore 26 and has a radially enlarged upper end 46 located in the enlarged top of respective bore 26 and resting on shoulder 28 and has its lower end connected to follower shank 40 by way of coupling spring helix 41 to bias the respective follower member upwardly so that the follower element 39 is resiliently urged into engagement with cam face 33.

One of the clutch tubes 43 releasably engages the upper end of a conventional ball point pen cartridge 47 and the other clutch tube 43 is coaxially connected to the rear tubular, pencil lead clutch actuating or control plunger member 48 of a mechanical pencil device 49 by way of a coupling tube or rod 50 telescoping engaging clutch tube 43 and plunger tube 48. The pencil device 49 is of well known construction and includes a tubular case 51, terminating in a lower lead guide tip portion 55 and provided with depressable plunger 48 which is spring biased upwardly. Depression of the plunger 48 advances lead through the tip 55 and release of the plunger 48 to its raised position locks the advanced lead.

Located in barrel top section 13 and resting atop body member 22 is a spring position member including circular base 52 having a vertical guide recess 53 in its border and a coaxial upwardly directed post 54. A tubular cylindrical plunger 56 having a trasverse partition wall 57 above the bottom thereof coaxially rests on base 52 and is provided at its bottom border with a radially projecting follower element 58 vertically slidably engaging a vertical groove 59 formed in a split sleeve 60 secured to the inside face of upper barrel section 13 so as to be rotatable therewith.

A vertical leg 61 depends from the wall of plunger 56 through base recess 53 into engagement with the top face of actuator member lug 35, the leg 61 always being in longitudinal alignment with lug 35 since plunger 56 is rotatable with bar 15 carried by cam 32 by way of barrel upper section 13. The plunger 56 is resiliently biased to a raised portion as limited by follower 58 abutting the top shoulder terminating groove 59 by a helical compression spring 63 encircling post 54 and entrapped between base 52 and wall 57. A push button defining cap 64 has its closed end uppermost and longitudinally slidable projects through the barrel rear opening 17 and is provided on its inside bottom border with an internally threaded collar 65 which engages the externally threaded upper end of cylindrical plunger 56. A sleeve 66 carrying an eraser 67 slidably nests in plunger 56 and abuts on wall 57, the eraser being accessible by removing the cap 64.

Figure 2:
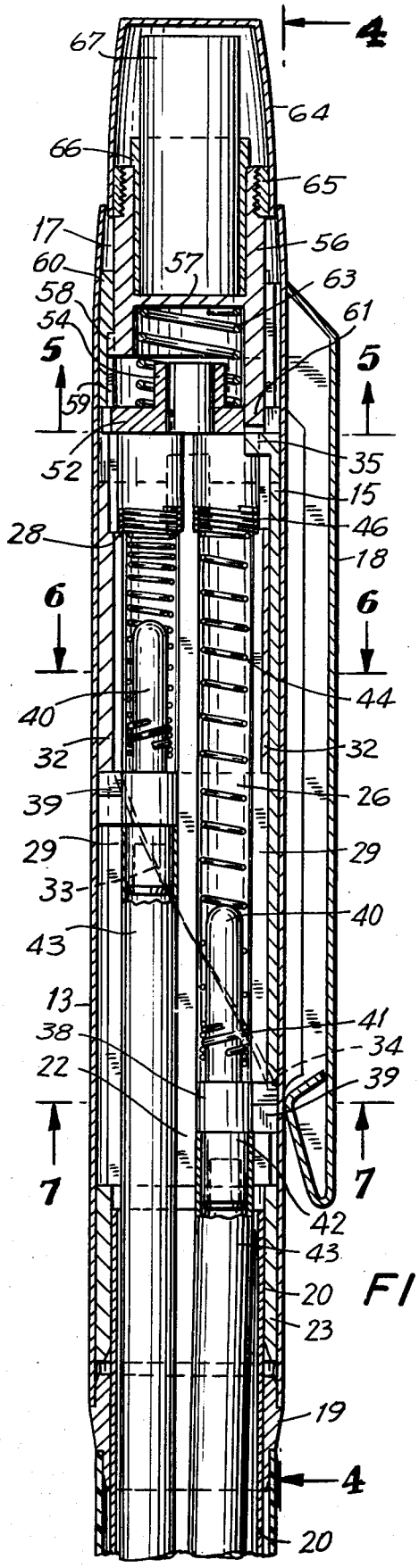
FIG. 2 is an enlarged sectional view taken along line 2—2 in FIG. 1.
Figure 3:
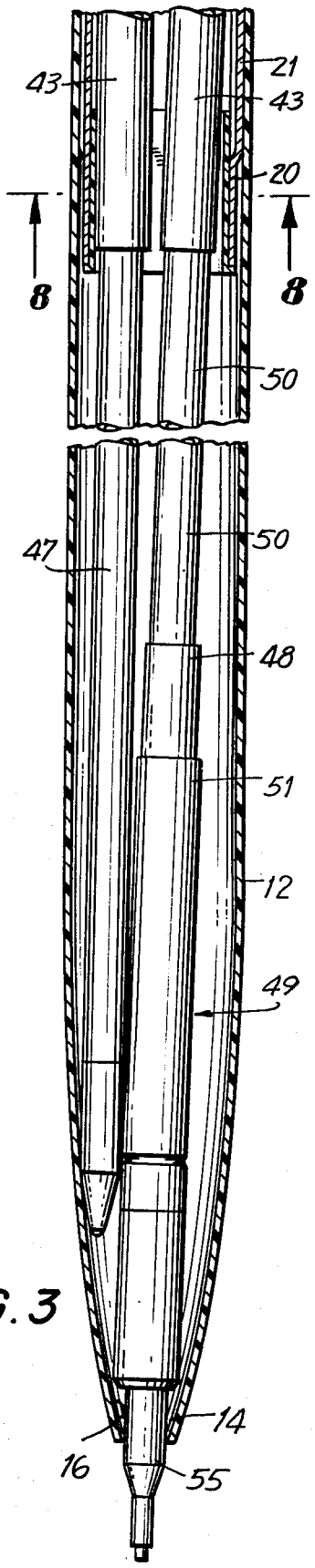
FIG. 3 is an enlarged sectional view taken along line 3—3 in FIG. 1.
Figure 4:
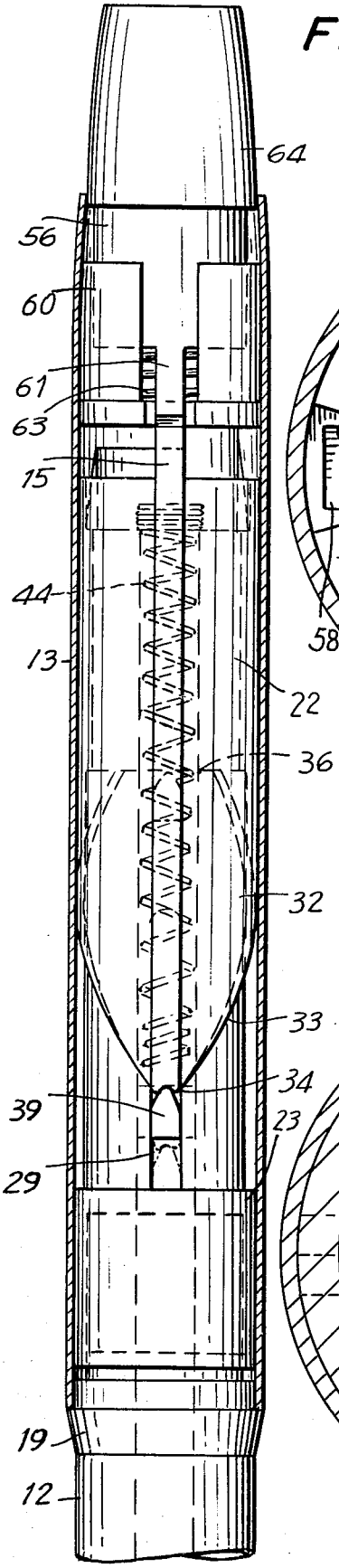
FIG. 4 is a sectional view taken along line 4—4 in FIG. 2.
Figure 5:
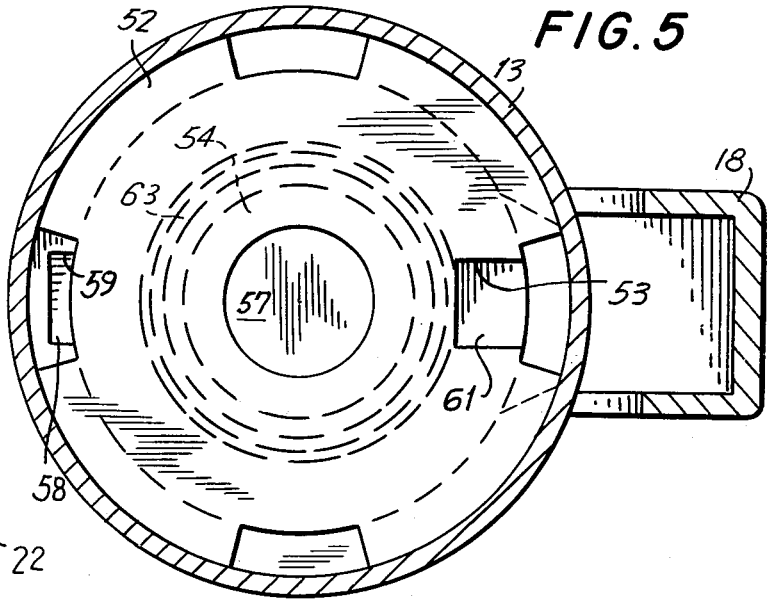
FIG. 5 is a sectional view taken along line 5—5 in FIG. 2.
Figure 6:
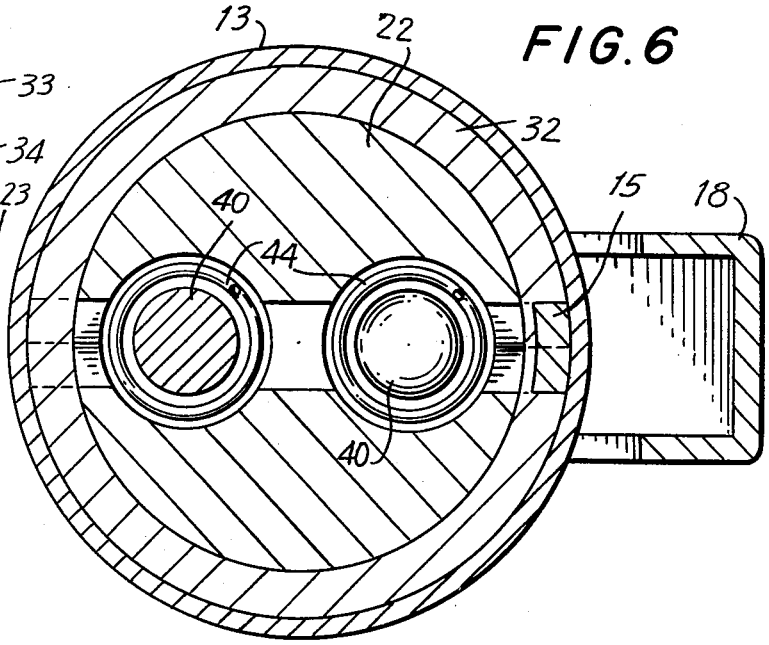
FIG. 6 is a sectional view taken along line 6—6 in FIG. 2.
Figure 8:
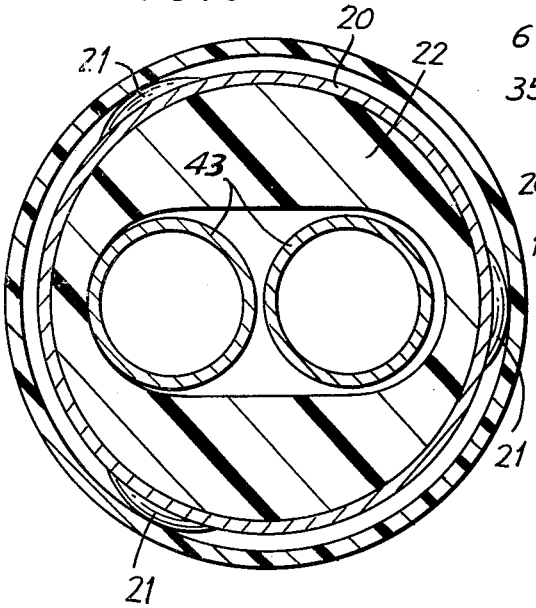
FIG. 8 is a sectional view taken along line 8–8 in FIG. 3.

In the operation of the writing instrument 10, to advance the pencil 49 to its operative extended position the lower and upper barrel sections 12 and 13 respectively are twisted relative to each whereby the cam 32 rotates relative to body member and the pencil coupled follower element 39 is advanced by an inclined run of cam face 33 until it reaches raised cam portion 34 and engages the notch therein, at which point the pencil tip 55 projects through front end opening 14. Simultaneously, the pen cartridge coupled follower element 39 moves upwardly over an inclined run of cam face 33 until it reaches dwell portion 36, at which point the pen cartridge 47 is in its fully retracted position as shown in FIGS. 2 and 3. If it is desired to propel lead in the pencil 49, while the pencil is in its advanced operative position, as shown in FIG. 3, the push buttom 64 is depressed to depress the follower engaging actuator member 15 by way of plunger leg 61 bearing on lug 35 to further advance, pencil member 49 bringing the shoulder delineating the pencil tip 55 from the pencil case 51 into abutment with front end opening shoulder 16 and thereafter depress the mechanical pencil plunger 48 to advance the pencil carried lead, as shown in FIG. 9. Upon release of push button 64 it, together with plunger 56 are retracted by spring 63 and the respective spring loaded follower elements 39 longitudinally moves the actuator member 15 to its initial longitudinal retracted position.

Figure 10:
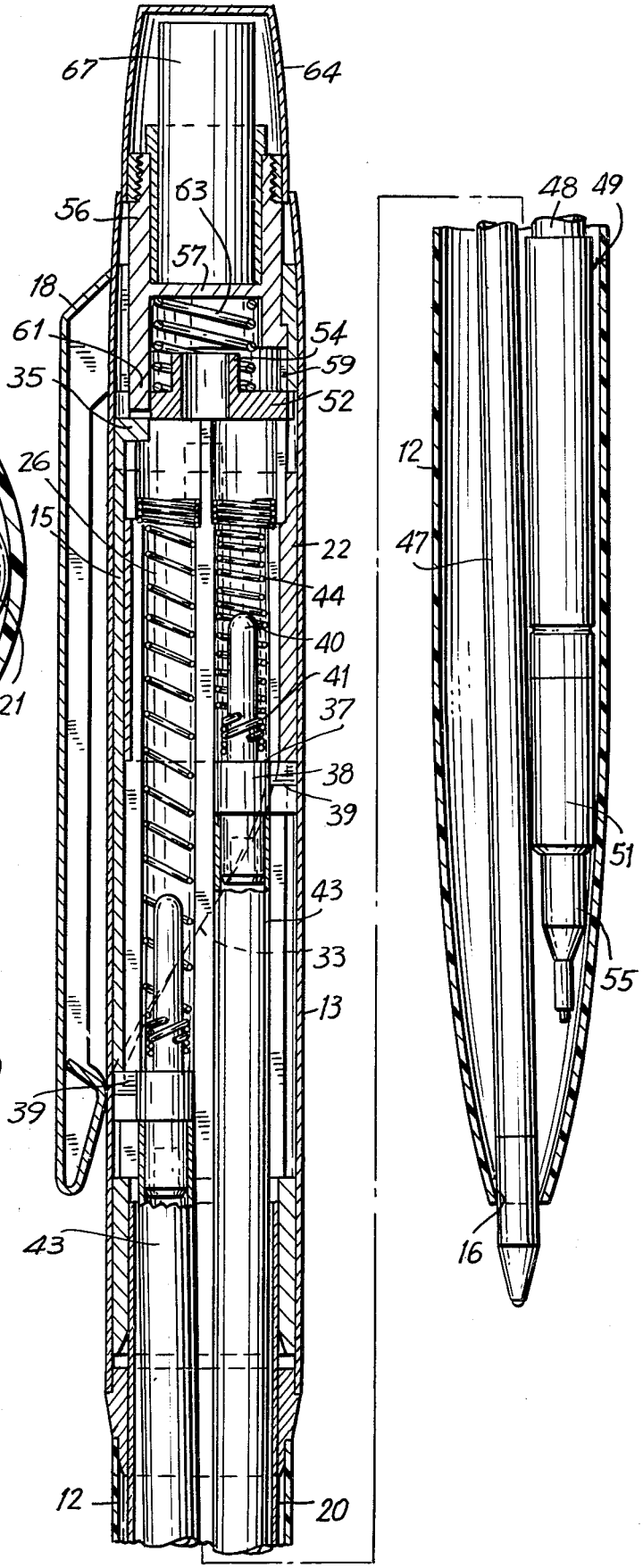
FIG. 10 is a view similar to FIG. 9 showing the adjustable unit in retractable position.

By turning the lower and lower barrel sections 12 and 13 relative to each other 180° from the position shown in FIGS. 2 and 3 in the pencil advanced position the pencil and pen cam follower elements 39 are respectively retracted and advanced to retract the pencil member 49 and advance the pen cartridge 47 to an advanced operative position projecting through front end opening 16, as shown in FIG. 10.

While there has been described and illustrated a preferred embodiment of the present invention, it is apparent that numerous alterations, omissions and additions may be made without departing from the spirit thereof.

I claim:

1. A writing instrument comprising a barrel member having a front end opening, a writing element located in said barrel member and longitudinally movable between an advanced operable position projecting through said front opening and a retracted position and adjustable in response to a longitudinal compressive force thereon, means for limiting the forward movement of said writing element to a predetermined advanced position, a follower member coupled to said writing element rearwardly of the front end thereof, a cam member rotatably located on said barrel member and having a cam engaging said follower member and shaped whereby rotation of said cam member to a predetermined position advances said writing element by way of said follower member to said advanced operable position, and an actuating member carried by said cam member and longitudinally selectively movable along a path intercepting said follower member when said writing element is in its advanced position whereby the advance of said actuating member when said writing element is in its advanced position applies an adjusting compressive force to said writing element.

2. The writing instrument of claim 1 wherein said cam face has a raised portion engaging said follower member in the advanced position of said writing element and said cam member includes guide means restricting the movement of said actuating member to a path intercepting said raised portion.

3. The writing instrument of claim 2 wherein said cam member is of hollow cylindrical configuration with said cam face being formed at an end face thereof, said guide means includes a longitudinal groove formed in the outer peripheral face of said cam member and said actuating member comprises a bar slidably engaging said guide groove between retracted and advanced positions with the forward end of said bar coinciding with and being forward of said raised cam portion respectively.

4. The writing instrument of claim 3 wherein said barrel member includes relatively rotatable front and rear barrel sections and further comprising a body member located in said barrel member and rotatable with a first of said barrel section and having formed therein a longitudinally extending guide recess slidably engaging said follower member and a longitudinal slot through which said follower member projects said cam member being rotatable with the second barrel section.

5. The writing instrument of claim 4 wherein said body member has formed therein a plurality of said longitudinally extending guide recesses and corresponding longitudinally extending slots, a writing element slidably engaging each of said slots and individually movable between extended operative and retracted positions and one of said writing elements defining said adjustable writing element and a follower member coupled to each of said writing elements and projecting through a respective slot into engagement with said cam face.

6. The writing instrument of claim 5 including spring means individually biasing said writing elements toward their retracted positions and said follower members into engagement with said cam face.

7. The writing instrument of claim 6 wherein said first and second barrel sections correspond to said front and rear barrel sections, said rear section having a rear end opening, and further comprising a longitudinally moveable push button motion coupled to said actuating member and projecting through said rear opening.

8. The writing instrument of claim 7 including spring spring means rearwardly biasing said push button.

9. The writing instrument of claim 5 wherein said adjustable writing element comprises a mechanical pencil device including a longitudinally extending main body member and a lead controlling longitudinally movable plunger projecting rearwardly from said body member and coupled to a respective follower member to be longitudinally movable therewith.

10. The writing instrument of claim 7 wherein said front barrel member is forwardly inwardly tapered proximate said front end opening to define a rearwardly facing inclined inside shoulder said adjustable writing element body member having a forwardly facing shoulder proximate its front end engaging said rearwardly facing shoulder when said adjustable writing element is proximate its advanced position.

* * * * *